United States Patent [19]

Cormier et al.

[11] 4,351,601

[45] Sep. 28, 1982

[54] SHEET STRIPPING HOLD DOWN ASSEMBLY

[75] Inventors: Raymond G. Cormier, Nashua; John D. Gibbs, Amherst, both of N.H.

[73] Assignee: Nashua Corporation, Nashua, N.H.

[21] Appl. No.: 162,500

[22] Filed: Jun. 24, 1980

[51] Int. Cl.[3] ..... G03G 15/00

[52] U.S. Cl. ..... 355/3 SH; 271/308; 271/312; 271/DIG. 2; 355/3 TR

[58] Field of Search ..... 355/3 R, 3 SH, 3 TR, 355/14 TR, 14 SH; 271/DIG. 2, 307, 308, 311, 312, 313

[56] References Cited

U.S. PATENT DOCUMENTS 3,936,045 2/1976 Ariyama ..... 271/DIG. 2

4,278,341 7/1981 Burgess et al. ..... 355/3 SH

*Primary Examiner*—Fred L. Braun

*Attorney, Agent, or Firm*—Kenway & Jenney

[57] ABSTRACT

In a photocopier, a sheet hold down member with a rounded end, extends to the photosensitive drum surface from a resilient support, adjacent the edge of a pick-off blade, near where sheets conveyed to the drum surface transfer station arrive. Portions of the sheet adjacent the blade are held down by the member to contact the image bearing drum surface, thereby minimizing image lost to the sheet.

5 Claims, 9 Drawing Figures

SHEET STRIPPING HOLD DOWN ASSEMBLY

BACKGROUND OF THE INVENTION

This invention relates generally to photocopying apparatus and particularly to apparatus for removing sheets from the photosensitive surface of a photocopying apparatus.

U.S. application Ser. No. 55,523, filed July 9, 1979, now U.S. Pat. No. 4,278,341, describes apparatus for removing sheet material from the photosensitive surface of a photocopier in which a leading corner edge of the sheet is directed to an output mechanism which catches the corner and pulls the remainder of the sheet through to the exit station. That application describes a pick-off blade which overlays a marginal portion of the drum photosensitive surface when the front edge of the sheet arrives at the drum surface. The side edge of the sheet slides along the blade interposed between it and the drum surface until it is caught by the output mechanism. Then the blade is pivoted away from the drum surface so that successive portions of the sheet can contact the drum surface fully from edge to edge.

This arrangement provides positive and reliable guidance to a sheet conveyed to the transfer station, but a corner of the sheet is thereby prevented from contacting the drum photosensitive surface and receiving a portion of the developed image carried thereon. The effect is heightened by the need for the blade to overlay the drum surface enough to accommodate side-to-side skew type variations in where the side edges of successive sheets arrive at the drum. Furthermore, not only is the portion of the sheet immediately in contact with the blade kept from contacting the drum surface, but a next adjacent "transitional" portion of the paper—the portion rising from contact with the drum surface to contact with the blade—is also kept out of contact with the drum surface. As the blade height off the drum is increased, to avoid contact with the drum photosensitve surface and the toned image carried thereon, the extent of the "transitional" portion is also increased.

It is a principal object of this invention to provide an improved sheet stripping apparatus operating in accordance with the principles described in application Ser. No. 55,523, and which is reliable, low in cost and simple in operation. Other objects are to provide a sheet stripping apparatus that minimizes the likelihood of damage to the drum photosensitive surface and maximizes the portion of the transfer sheet that may receive developed image from the drum surface.

SUMMARY OF THE INVENTION

This invention relates to a copying apparatus with a moving reusable photosensitive surface. A scanner scans the original to be copied to produce a latent electrostatic image on the drum surface, which is then developed. The developed image is transferred to a transfer material at a transfer station where a sheet is conveyed to the drum surface, stripped from the surface, and transported away.

The sheet stripping apparatus includes a movable guide member with a pick-off blade which overlays a marginal portion of the drum surface during sheet stripping, for engaging at least a corner of a leading edge of a conveyed sheet of transfer material and guiding it to a sheet transporter.

The invention features a sheet hold-down assembly including a support member extending substantially normally to the photosensitive surface's direction of movement and a hold down member extending from the support member to the drum surface adjacent the edge of the blade. The hold-down member terminates adjacent the photosensitive surface in a hold-down surface under which the transfer sheet conveyed to the drum passes, whereby sheet portions adjacent the guide member edge are held down in contact with the photosensitive surface.

In a preferred embodiment, the hold-down member extends normally to the photosensitive surface and terminates in a rounded surface contacting the transfer sheet substantially at a point, and the assembly includes a support member that is resilient and supported in the copying apparatus at a fixed position and from which said hold-down member extends to resiliently contact the transfer sheet. The location of the surface is near where the front edge of the transfer sheet meets the photosensitive surface as it is conveyed to the surface.

BRIEF DESCRIPTION OF THE DRAWING

Other objects, features and advantages of the invention will appear from the following description of a preferred embodiment, including the drawings, in which.

DESCRIPTION OF PREFERRED EMBODIMENTS

Figure 1:
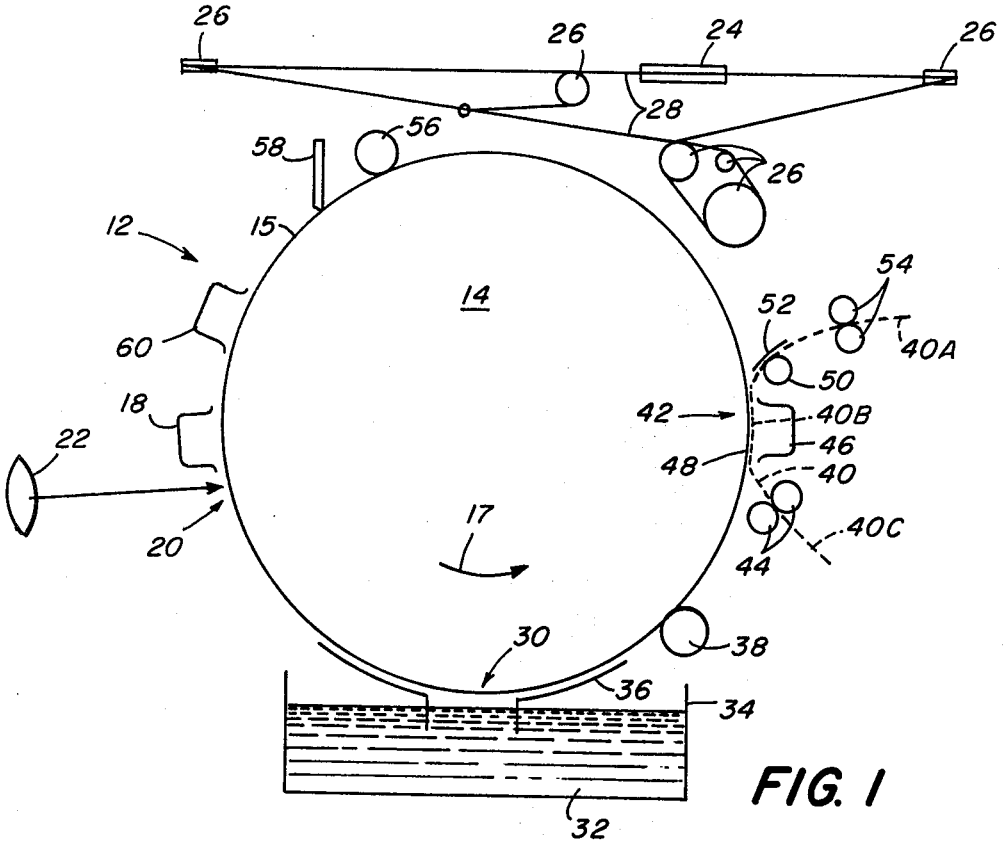
FIG. 1 is a schematic front elevation view of a photocopier in which the present invention is incorporated.

Referring to FIG. 1, there is shown a photocopier 12 in which the present invention can be employed, having a photosensitive drum 14, preferably one having a surface 15 of a photosensitive selenium layer deposited on an aluminum substrate 16, rotating in the counterclockwise direction as indicated by the arrow 17. A charge corona 18 charges the drum 14 to about +1000 volts D.C. The charged drum 114 is exposed to an image at an exposure station 20 transmitted to the drum through a lens 22. In the illustrated embodiment the lens 22 receives the image through an arrangement of mirrors, not shown, from a scanner 24 operated by an arrangement of pulleys 26 and cables 28.

The image is focused on the drum photosensitive surface 15 and thereupon the charge on the drum surface forms an electrostatic latent image comprising a pattern of electrical charges. The electrostatic latent image on the drum surface 15 is brought to a development station 30 where a liquid developer 32 having a negatively charged toner contacts the electrostatic image to develop the image. The development station 30 incluees a developer tank 34 and a development electrode 36. Developer 32 is introduced between the development electrode 36 and the drum surface 15 to develop the electrostatic image. The drum surface 15, now wetted and carrying the developed image, travels past a metering roll 38 which controls and limits the thickness of the liquid developer 32 on the drum surface 15.

A copy material, which is preferably a sheet 40, is fed to the drum surface 15 at a transfer station 42. The sheet 40 is conveyed to the surface by sheet registration rollers 44. There, the sheet 40 contacts the drum surface 15. A positive charge from a transfer corona 46 is applied to the back side of the copy material sheet 40, causing the transfer of toner particles from the developed image on the drum's surface 15 to the copy sheet 40. An edge portion 40D of the front of the sheet 40 is kept off the drum surface by a pick-off blade 48 that directs the sheet 40 to a feed-away roller 50 and paper guide 52. The sheet is fed along a path to other rollers 54 that transport the sheet to the exterior receiving tray (not shown) of the photocopier 12.

After transfer, there remains on the drum surface 15 a residue of liquid toner that is removed by a surface contacting cleaning roller 56 and a cleaning blade 58. Finally, the drum surface is electrically neutralized prior to the next charging step by a high voltage A.C. neutralizing charge from a discharge corona 60.

When the sheet 40 of transfer material, usually paper, is brought to the transfer station 42, the sheet contacts the drum surface 15 in successive portions. Referring to FIG. 1, for example, it can be seen that a leading portion 40A of the sheet is between rollers 54 for transport away from the drum surface. An intermediate portion 40B of the sheet is in contact with the drum surface 15 at the transfer station 42, where image transfer occurs. A trailing portion 40C of the sheet is being conveyed to the transfer station 42.

Figure 2:
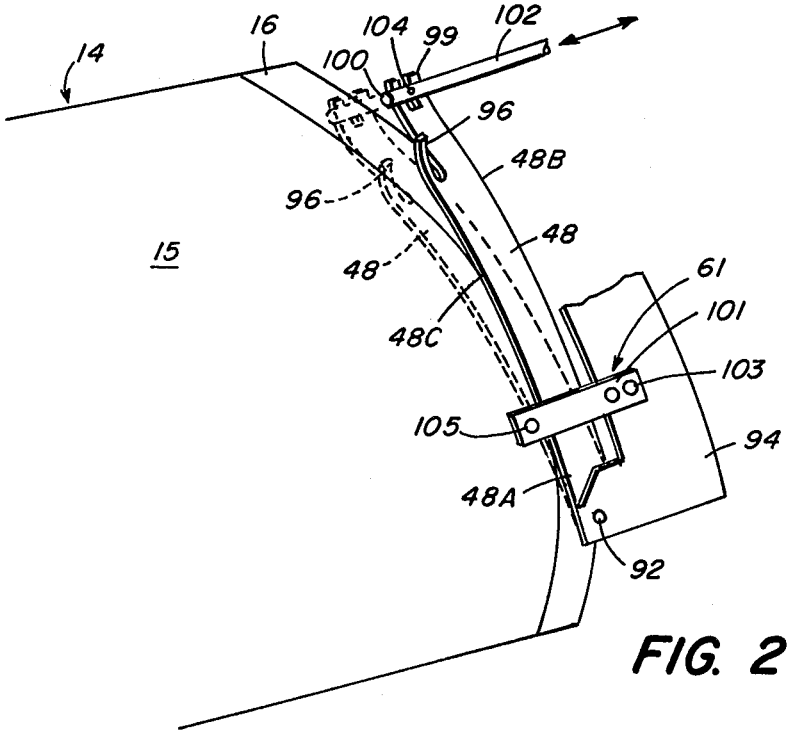
FIG. 2 is a perspective view of a portion of the photocopier drum, the pick-off blade, and the sheet hold-down apparatus.
Figure 3:
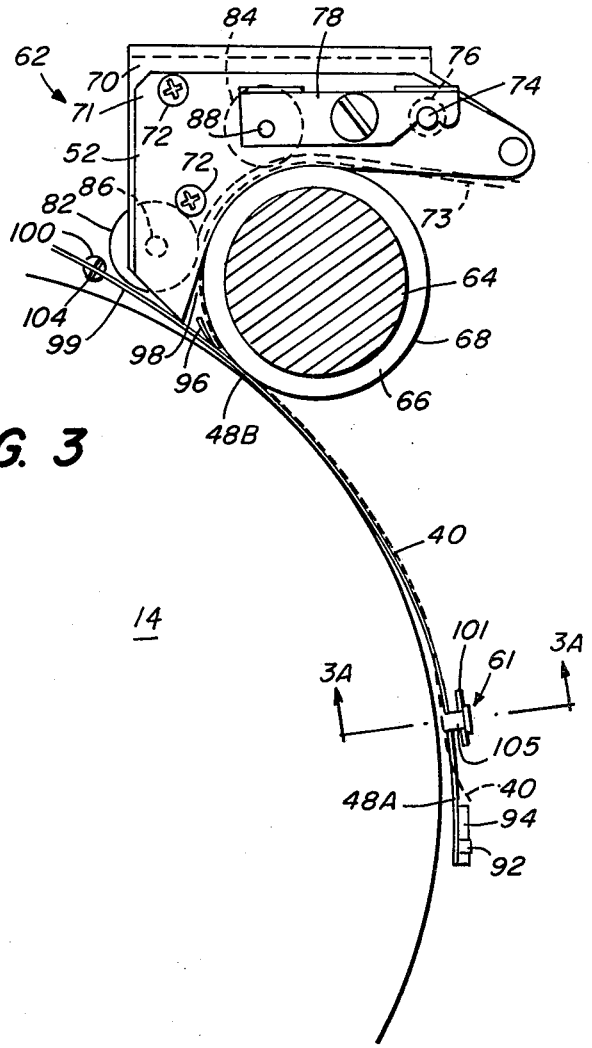
FIG. 3 is a front elevation view of a portion of the drum and the sheet stripping apparatus.
Figure 3A:
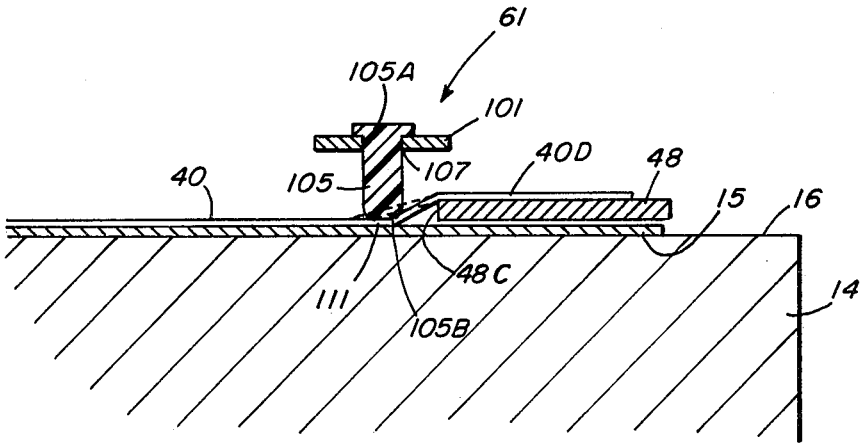
FIG. 3A is a detail sectional view of the dru, pick-off blade and sheet hold-down apparatus, along the lines 3A—3A of FIG. 3.

FIGS. 2, 3, and 3A show in greater detail portions of the drum 14, the pick-off blade 48 and a sheet hold-down apparatus 61.

FIG. 3 shows also, just above the pick-off blade 48, a sheet transport assembly 62 that includes the feed-away roller 50 and the paper guide 52 of FIG. 1. The feed-away roller 50 is mounted for free rotation on a shaft 64. Shaft 64 in turn is positionally fixed adjacent the drum by the paper handling portion of the photocopier frame. The roller preferably has a metal body 66 with a surface layer 68 of rubber.

The rest of the illustrated sheet transport assembly 62 is supported adjacent the roller 50 by the paper handling frame section and includes a vertically oriented base plate 70 with a shim plate 71 secured to it by screws 72. The shim plate, made for example from a plastic material such as that sold under the trademark, Mylar, has a lower edge 73 shaped to conform to a portion of the circumference of the feed-away roller 50 so that a paper sheet 40 carried around the roller is guided by the edge. The base plate 70 is pivotally secured to a stud 74 mounted on the photocopier frame. Plate 70 carries a cylindrical collar 76 projecting from the back of the base plate which mates with stud 74. A locking latch 78 is pivotally mounted on the face of the assembly to engage a groove in the stud 74 to lock the assembly into position. The assembly further has a lower knurled wheel 82 and a upper knurled wheel 84 secured to and mounted for free rotation on shafts 86, 88 respectively. Shafts 86, 88 project rearwardly from the base plate 70. When the assembly 70 is locked into position, the knurled wheels 82, 84 ride along the feed-away roller 50 to grip and transport the image carrying "wet" side of sheets 40 around the roller 50, guided by the edge 73 of the shim plate 71.

As shown in FIG. 2, the drum surface selenium photosensitive layer 15 extends over the aluminum substrate 16, typically leaving an edge of the substrate 16 not covered by selenium. The pick-off blade 48 is located below the transport assembly 62 adjacent the marginal edge of the drum photosensitive surface 15. The blade 48 is curved and conforms generally to the circumference of the drum 14. The illustrated blade is pivotally mounted for quick release at its lower end 48A by a spring loaded stud member 92 extending from a bracket 94 secured to the photocopier rear panel (not shown) and the blade 48 is movable between the positions shown in FIG. 2 by dashed and solid line representations of the blade. Preferably, the blade is spaced from the drum surface 15 so that its movement will not create wear on the surface.

In a first position of the blade 48, which is shown by the dashed line representation in FIG. 2, the blade 48 partially overlays the marginal edge of the photosensitive surface 15 of the drum. With the blade 48 in that position, if a sheet 40 is directed to the drum 14 by the sheet registration rolls 44, a side edge portion 40D of the sheet 40 will slide along the interposed blade rather than contact the photosensitive surface 15 of the rotating drum 14. The upper end 48B of the blade has a tang 96 projecting toward the sheet transport assembly 62, particularly to the nip 98 formed between the feedaway roller 50 and the lower knurled wheel 82, so that the leading edge 40A of a sheet 40 sliding along the blade 48 is eventually engaged by the roller 50 and wheel 82 of the assembly.

The sheet hold-down assembly 61 includes a flat, resilient support plate 101 made, for example, of 0.012 inch stainless shim stock. The support plate 101 is fixed at one end by two screws 103 to the bracket 94 on which the blade 48 is pivotally mounted. The support plate 101 extends over the blade 48, parallel to the drum axis, that is, normal to the direction of movement of the photosensitive surface. Sheet hold-down member 105 extends downwardly from the end of the support plate 101 opposite that fixed to the bracket 94. The illustrated hold-down member 105 is a longitudinal rod about 0.096 inch in diameter, extending about 0.15 inch below the support plate 101. The hold-down member 105 is mounted in the support plate 101 by passing through a hole 107 in a press fit; the member includes a head 105A, slightly larger in diameter than the hole 107.

The hold-down member 105 is made preferably of a polyolefin, such as that sold under the trademark "Pennlon" by Dixon Corporation, of Bristol, R.I. It extends substantially normally to the drum photosensitive surface 15, and terminates in a rounded surface 105B touching the drum surface at substantially a point contact. Rounded surface 105B in combination with the drum surface define an entrance "throat region" 111 into which the copy material is directed. The hold-down member 105 extends to the surface 15 of the drum just adjacent the inner edge 48C of the blade 48 when it is in the first position, overlaying a marginal portion of the drum photosensitive surface 15 (as shown by the dotted representation in FIG. 2). At this position, the hold-down member 105 may hold down a part of the sheet edge portion 40D close to the photosensitive surface 15 of the drum where it may pick up the developed image on the surface, a part that would ordinarily not be close to the surface 15 because it is in a transition zone between the sheet portion on the drum surface 15 and the sheet portion on the blade 48. The dashed representation in FIG. 3A shows the position that this part of the sheet would take in the absence of the hold-down member 105.

Relative to the length of the pick-off blade 48, the sheet hold-down assembly 61 is located preferably near the pivotal end 48A, near where the transfer sheet 40 first approaches the drum photosensitive surface 15. Its position near the pivotal end of the pick-off blade places it at the edge of the field of charge of the transfer corona 46, assuring that no arcing occurs. Moreover, the assembly 61 appears to have no appreciable effect on the charge applied by the transfer corona 46 even if it is positioned beneath the corona.

The upper end 48B of the blade includes a forked portion 99 over which the split end 100 of a laterally movable actuator rod 102 passes. A pin 104 through the split end 100 of the rod passes between the teeth of forked portion 99 of the blade so that lateral movement of the actuator rod 102 will pivot the blade 48 about its pivot screw 92. In the second position of the blade 48, shown by the solid line representation in FIG. 2, the illustrated blade no longer overlays any portion of the photosensitive drum surface 15, so that successive portions of the sheet 40 brought to the drum 14 will contact the photosensitive drum surface 15 fully, from one side edge of the sheet to the other.

Figure 4:
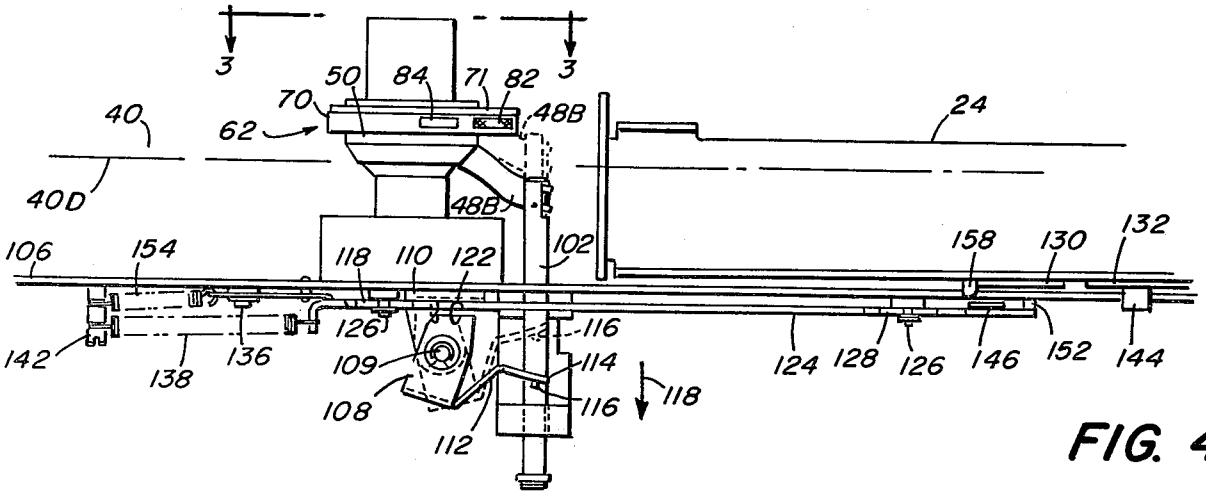
FIG. 4 is a plan view of the sheet stripping apparatus shown in FIG. 3, showing particularly the linkage between the scanner of the photocopier and the apparatus shown in FIG. 3.

FIG. 4 shows the relation between the actuator rod 102 and the other elements of the photocopier apparatus. The figure also shows the positions of the roller 50, lower and upper knurled wheels 82 and 84, and paper guide shim plate 71 of the sheet transport assembly 62 relative to the pick-off blade 48. It also shows the relative position of a side edge portion 40D of a sheet of paper 40 in the apparatus.

The actuator rod 102 for pivoting the blade 48 passes through a rear panel 106 of the photocopier and is connected to an actuator pivot 108 pivotally mounted on a pin 109 in a bracket 110 secured to the rear panel 106. The actuator pivot 108 has an arm 112 with a forked end 114 that engages a pin 116 extending through the actuator rod, so that lateral rearward movement of the actuator pivot arm 112 moves the actuator rod 102 rearward (in the direction of the arrow 118). The actuator rod 102 is connected by a spring 120 (see FIGS. 5–7) to the rear panel 106, so that it is constantly biased to move forward.

The actuator pivot 108 is operated by a pin 122 extending down from a slide 124 to engage a gap 125 in a forward extension of the actuator pivot arm 112. The slide 124 is secured to the rear panel 106 by studs 126 passing through horizontal slots 128 in the slide 124, so that the slide can move horizontally. Two brackets mounted on the scanner 24, a slide release bracket 130 and a trigger bracket 132, actuate movement of the slide 124. The different positions of the scanner 24 during operation of the photocopier, and the effect on the slide 124 and the actuator rod 102 can be seen by also referring to FIGS. 5–7.

Figure 5:
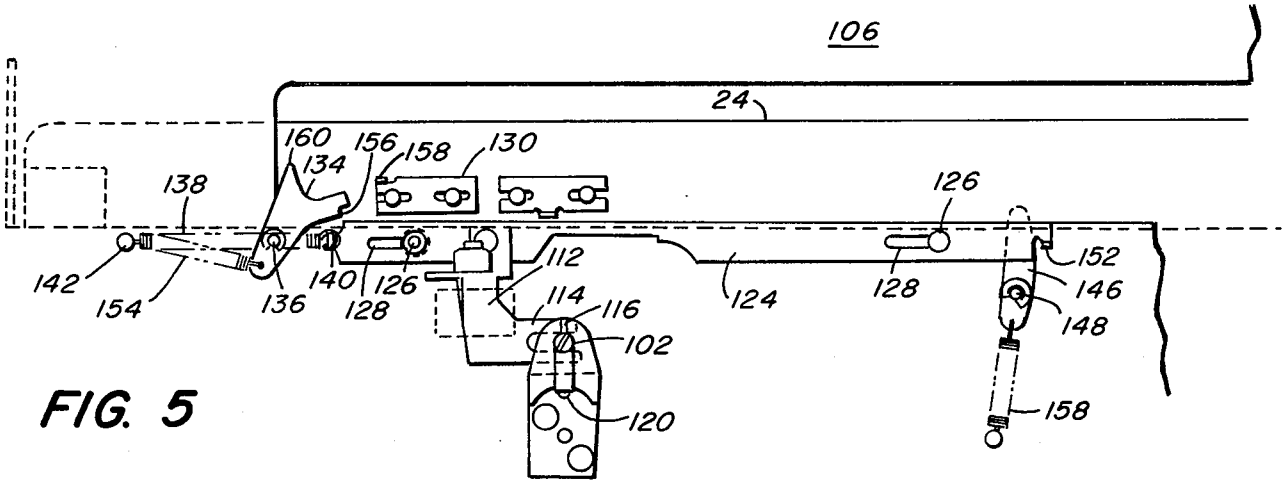
FIG. 5 is an elevation view of the linkage shown in FIG. 4, in a position in which the scanner is at the start of its path of travel.

In the position shown in FIG. 5, the scanner 24 has not yet begun to scan the original, and the scanner brackets 130, 132 are located over the left portion of the slide 124. A slide lock 134, pivotable about a pin 136, is in an unlocked position. The slide 124 is biased to the left by a spring 138 extending from a rearwardly projecting tab 140 at the end of the slide to a fastener 142 secured to rear panel 106. In this position of the slide 124, the actuator pivot arm 112 is not urging the actuator rod pin 116 rearward, and, the actuator rod 102, reacting to the bias exerted by the actuator spring 120, extends forwardly (as shown by the dashed representation in FIG. 4). When the actuator rod 102 is in this position, the pick-off blade 48 is in the position in which it overlays the marginal edge of the drum photosensitive surface 15 (as shown by the dashed line representation in FIGS. 2 and 4).

Figure 6:
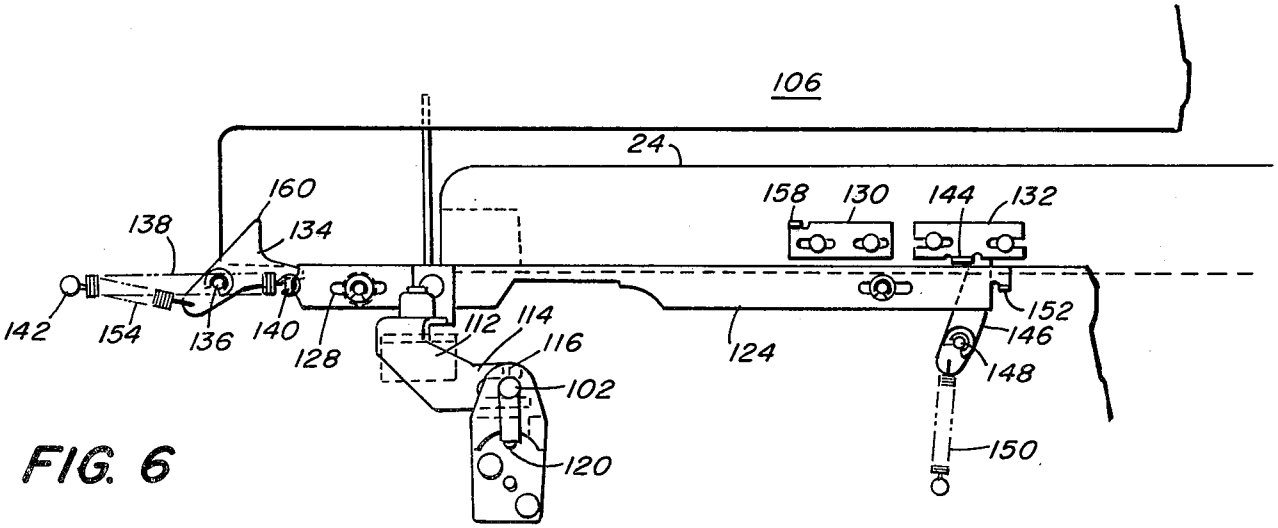
FIG. 6 is a view similar to that of FIG. 5 in which the scanner is at intermediate point in its path of travel.

In a second position of the apparatus, shown in FIG. 6, the scanner 24 has moved to the right, and the trigger bracket 132 is shown in a position in which a tab 144 extending rearwardly from the bottom of the bracket 132 engages a slide positioner 146. The slide positioner 146 is a flat, elongate element that extends between the slide 124 and the rear panel 106. The positioner 146 is pivotally mounted on a pin 148 and biased by a spring 150 to maintain an upright position. When the trigger bracket 132 is moving to the right, as shown in FIG. 6, the trigger bracket tab 144 engages the slide positioner 146 which in turn engages a forwardly extending tab 152 at the right end of the slide 124, moving the slide to the right. When the slide 124 moves to the right, the actuator pivot arm 112 swings rearwardly because of the movement of the slider pin 122, the actuator rod pin 116 is urged rearward by the actuator arm 112, and the rearward movement of the actuator rod 102 moves the pick-off blade 48 to its second position (as shown by the solid line representation of the elements in FIGS. 2 and 4), clear of the drum photosensitive surface. When the slide 124 moves further to the right, the pivotable lock 134 at its left end, biased by a spring 154 to pivot clockwise, does so, and a slide locking surface 156 (FIG. 5) is moved into position against the end of the slide 124, blocking leftward movement of the slide.

Figure 7:
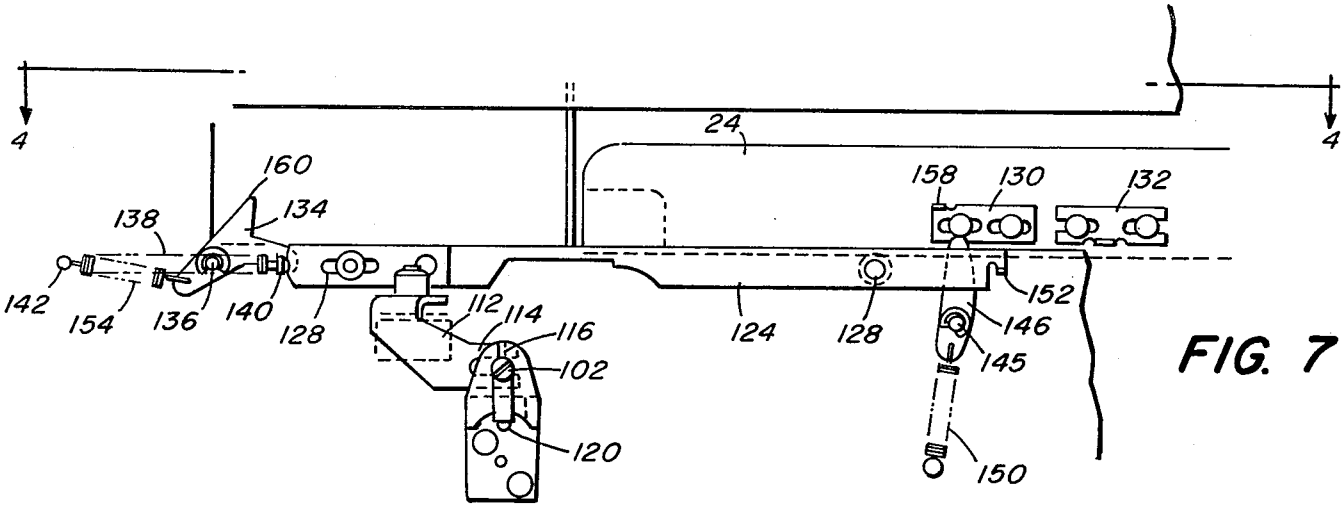
FIG. 7 is a view similar to that of FIG. 6 in which the scanner has gone further in its path of travel.

In a third position of the scanner 24, illustrated in FIG. 7, the scanner 24 has moved further to the right, but no change is effected in the position of the slide 124, which remains locked in place. The scanner 24 can move further and further to the right without effecting any change in the position of slide 124.

When the scanner 24 returns to its original position, a slide release tab 158, extending rearwardly from the slide release bracket 130, engages an upward extension 160 of the slide lock 134, pivoting it counterclockwise to release the slide 124, which then moves leftward in response to the bias force of spring 138. Slide 124 moves leftward until it engages the studs 126 and the entire assembly is restored to the first position, shown in FIG. 5. The pick-off blade 48 is accordingly also restored to its first position (the dashed line representation of FIG. 2).

Figure 8:
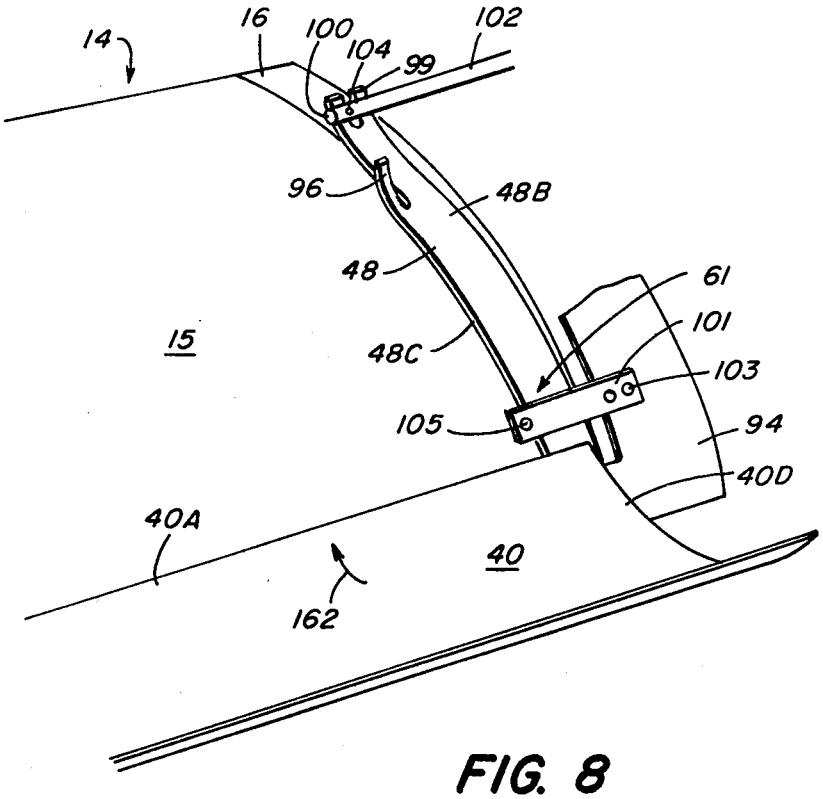
FIG. 8 is a perspective view like that of FIG. 2, showing the front edge of a transfer sheet being conveyed to the drum surface.

During operation of the photocopier 12, a sheet 40 is conveyed to the drum photosensitive surface 15 after the scanner 24 has begun to scan the original (see FIG. 8). As the first portion of the developed image on the drum surface 15 approaches the transfer station 42 the leading portion 40A of the transfer sheet 40 is brought to the drum surface 15 by the registration rollers 44 in the direction shown by the arrow 162. At this time the pick-off blade 48 is in its first position, as shown in FIG. 8, corresponding to the dashed line representation in FIG. 2. As the leading portion 40A of the transfer sheet comes into contact with the drum surface 15, the side edge portion 40D slides along the pick-off blade 48. The leading portion 40A of the sheet enters the throat area 111 and is caught under the hold-down member 105. The portion of the sheet edge portion 40D just next to the edge 48C of the pick-off blade 48 is pressed to the surface 15 of the drum by the hold-down member 105 (see FIG. 3A), so that it can pick up developed image toner there.

The leading edge corner of the sheet 40 is subsequently brought by the tang 96 of the pick-off blade 48 into engagement with the nip 98 of the roller 50 and lower knurled wheel 82 of the sheet transport assembly 62. The alignment of the brackets 130, 132 on the scanner 24 is selected so that after this engagement of the paper, the slide 124 is brought to the position shown in FIG. 6, and the pick-off blade 48 is pivoted away from its first position to its second position, clear of the drum photosensitive surface 15. The blade remains in this second position at least until after the sheet 40 has left contact with the drum surface 15 and the transfer process is completed. The return of the scanner 24 to its original position restores the blade 48 to its position, overlaying the drum surface 15.

Thus it can be seen that successive portions of the transfer sheet after the leading portion 40A contact the photosensitive drum surface 15 completely, from one side edge of the sheet to the other. At the conclusion of the transfer process the scanner 24 returns to its original position and returns the pick-off blade 48 to its original position. The pick-off blade 48 overlays the photosensitive surface 15 for a period only long enough to allow the leading corner of the transfer sheet 40 to be engaged by the sheet transport assembly 62. As soon as that goal is accomplished, the pick-off blade 48 is moved away from its overlying position and the transfer sheet 40 can contact the drum surface fully. Only a small corner of the transfer sheet 40 is not available for copying purposes. The amount of the corner not available for copying purposes is reduced by the action of the hold-down member 105 of the hold-down assembly 61.

Advantages of the Invention and Non-Obviousness

The invention provides a reliable, easily constructed assembly for minimizing the amount of image lost, for example to a corner of a transfer sheet when a movable pick-off blade is used as part of the transfer sheet stripping apparatus. A flexible support plate of readily available material may be mounted on an existing bracket. U.S. Pat. No. 3,936,045 (Ariyama) shows a guide blade interposed between a marginal portion of a drum surface and conveyed sheets. Also shown in one of the embodiments is a wire "presser member" which includes an arcuate wire element that conforms to the drum surface next to the guide blade to hold down the transfer sheet portion adjacent the blade. In the invention disclosed in this application, however, a rod extending from the plate and terminating with a rounded end giving substantially point contact to the drum surface is surprisingly adequate for defining a throat entrance region and for the task of holding down a portion of transfer sheet that would otherwise be lost to image-carrying use.

In the illustrated embodiment, the hold-down member is in contact with the drum surface before the leading edge of the conveyed sheet reaches it. The flexibility of the support plate of the hold-down assembly allows the hold-down member to rise as the sheet passes under it. Since all that is required of the hold-down member is that it reduce the gap available to paper portions in the transition zone just off the edge of the pick-off blade, the member need not actually contact the drum surface. Also, the particular configuration and orientation of the hold-down member may be varied from the illustrated embodiment.

Other alternative modifications, deletions, or additions will be obvious to those skilled in the art and are within the scope of the following claims.

What is claimed is:

1. In a copying apparatus having:

a moving reusable photosensitive surface, means for scanning an original to produce a latent electrostatic image on said surface, means for developing said latent image, and a transfer station for transferring said developed image onto a transfer material, said transfer station having:

means for conveying a sheet of transfer material into contact with said photosensitive surface at said transfer station for transferring said developed image from said surface to said sheet, portions of said sheet successively contacting said surface, means for stripping said sheet from said surface, and means for transporting said stripped sheet from said transfer station, said sheet stripping means including a guide member having a sheet pick-off blade which, during sheet stripping, overlays a marginal portion of said surface at said transfer station for engaging at least a corner of a leading edge of said sheet conveyed to said transfer station and guiding said leading edge to said transport means, a sheet hold down assembly comprising a support member extending substantially normally to the direction of movement of said photosensitive surface, and a sheet hold-down member, supported by said support member, comprising a longitudinal member extending from said support member normally to said photosensitive surface at a position adjacent the edge of said blade, said sheet hold-down member terminating adjacent said photosensitive surface in a hold-down surface for holding down said transfer sheet conveyed to said drum surface, whereby sheet portions adjacent said blade edge are urged in contact with said photosensitive surface.

2. The sheet hold-down assembly of claim 1 wherein said hold-down member terminates in a rounded surface for contacting said transfer sheet substantially at a point.

3. The sheet hold-down assembly of claim 1 wherein said support member is a resilient support member supported in said copying apparatus at a fixed position, said hold-down member extending from said support member to resiliently contact said transfer sheet.

4. The sheet hold-down assembly of claim 1 wherein said hold-down member is located near where the front edge of the transfer sheet meets the photosensitive surface as it is conveyed to the surface.

5. In a copying apparatus having:

a moving reusable photosensitive surface, means for scanning an original to produce a latent electrostatic image on said surface, means for developing said latent image, and a transfer station for transferring said developed image onto a transfer material, said transfer station having:

means for conveying a sheet of transfer material into contact with said photosensitive surface at said transfer station for transferring said developed image from said surface to said sheet, portions of said sheet successively contacting said surface, means for stripping said sheet from said surface, and means for transporting said stripped sheet from said transfer station, said sheet stripping apparatus including a guide member having a sheet pick-off blade which, during sheet stripping, overlays a marginal portion of said surface at said transfer station for engaging at least a corner of a leading edge of said sheet conveyed to said transfer station and guiding said leading edge to said transport means, a sheet hold down assembly comprising a resilient support member supported in said copying apparatus at a fixed position and extending substantially normally to the direction of movement of said photosensitive surface, and a sheet hold-down member, supported by said support member, comprising a rod-like member having an axis extending from said support member normally and directly to said photosensitive surface, at a position adjacent the edge of said blade and near where the front edge of the transfer sheet meets the photosensitive surface as it is conveyed to the surface, said sheet hold-down member terminating adjacent said photosensitive surface in a hold-down surface for resiliently holding down said transfer sheet conveyed to said drum surface, whereby sheet portions adjacent said blade edge are urged in contact with said photosensitive surface.

* * * * *